US008957773B1

(12) United States Patent
Jasem

(10) Patent No.: US 8,957,773 B1
(45) Date of Patent: Feb. 17, 2015

(54) BOOKMARK WITH TIMER AND ALARM TO PROMOTE READING

(71) Applicant: Naser Hayawi Naser Jasem, Shuhada (KW)

(72) Inventor: Naser Hayawi Naser Jasem, Shuhada (KW)

( * ) Notice: Subject to any disclaimer, the term of this patent is extended or adjusted under 35 U.S.C. 154(b) by 0 days.

(21) Appl. No.: 14/487,044

(22) Filed: Sep. 15, 2014

(51) Int. Cl.
*G08B 19/00* (2006.01)
*G08B 21/18* (2006.01)
*B42D 9/00* (2006.01)

(52) U.S. Cl.
CPC ..... *G08B 21/18* (2013.01); *B42P 2221/02* (2013.01); *B42D 9/007* (2013.01)
USPC ..... 340/522; 116/234

(58) Field of Classification Search
CPC .... B42D 9/004; B42D 9/007; B42P 2221/02; G06F 15/02; G06F 15/16
USPC ..... 340/522; 368/11; 116/234
See application file for complete search history.

(56) References Cited

U.S. PATENT DOCUMENTS

| | | | | |
|---|---|---|---|---|
| 5,199,104 | A | 3/1993 | Hirayama | |
| 6,424,984 | B1 | 7/2002 | Yao | |
| 7,260,025 | B2 | 8/2007 | Farinella et al. | |
| 8,018,796 | B2 * | 9/2011 | Farinella et al. | 368/11 |
| 2007/0058944 | A1 | 3/2007 | Millar | |
| 2007/0258335 | A1 * | 11/2007 | Farinella et al. | 368/107 |

OTHER PUBLICATIONS

"Mark-My-Time Digital Bookmark," Kenson Parenting website, retrieved Jul. 9, 2014, http://www.kensonparenting.com/products/mark-my-time-digital-bookmark, 2 pages.
Overview Photocells Adafruit Learning System, retrieved Jul. 16, 2014, https://learn.adafruit.com/photocells, 7 pages.
"LilyPad Light Sensor", SparkFun Electronics, retrieved Jul. 16, 2014, https://www.sparkfun.com/products/8464, 6 pages.
"Lilypad—Light Sensor", Lilypad Light Sensor—v13, sheet 1/1, May 19, 2011, 1 page.
"Lilypad—MainBoard", Mainboard—v18, sheet 1/1, Oct. 16, 2008, 1 page.
LilyPad, "LilyPad Arduino SimpleSnap", retrieved Aug. 6, 2014, http://lilypadarduino.org/?p=289, 3 pages.
Atmel®, Atmega328, Key parameters for ATmega328, retrieved Aug. 6, 2014, http://www.atmel.com/devices/atmega328.aspx?tab=parameters, 5 pages.
Atmel®, Atmega328, Overview, retrieved Aug. 6, 2014, http://www.atmel.com/devices/atmega328.aspx?tab=overview, 2 pages.

* cited by examiner

*Primary Examiner* — John A Tweel, Jr.
(74) *Attorney, Agent, or Firm* — Richard C Litman

(57) ABSTRACT

A bookmark with timer and alarm to promote reading includes an electronic circuit that alerts the reader to continue reading a book, magazine, etc. after a specified elapsed time. A controller, such as a microcontroller unit, is associated with a light sensor, such as a CdS light sensor, a light source and/or a sound source. When the light sensor senses light, an interior timer resets to an initial time, and when the light sensor senses dark, or does not detect a minimum threshold amount of light, the timer starts counting for a user specified waiting time of a first time period. If the user does not begin reading the book in a lit environment for a second time period during the count of the first time period, at least one alarm of the light source and/or sound source is activated to alert the user, according to user specified settings.

20 Claims, 3 Drawing Sheets

BOOKMARK WITH TIMER AND ALARM TO PROMOTE READING

BACKGROUND OF THE INVENTION

1. Field of the Invention

The present invention relates generally to bookmarks, and particularly to a bookmark with timer and alarm to promote reading.

2. Description of the Related Art

Reading is a useful activity for education, self-improvement, relaxation, and pleasure. Individuals read fiction and non-fiction books on topics such as science, mathematics, language arts, health, history, technology, current events, finance, marketing, management, philosophy, music, arts, adventure, comedy, drama, romance, and personal hobbies, for example. Students read a variety of books as an integral part of their studies and homework assignments. Some books impart directed useful knowledge and skills; other books are read just to improve reading skills. Individuals also tend to read to improve personal skills, learn new ideas, and expand their knowledge base. Most if not all individuals read for enjoyment and leisure. But for some individuals, reading can be a chore, or can compete for time with other activities. As such, it would be desirable to have a compact device, such as incorporated with a bookmark, as can assist in providing an incentive or reminder to individuals to pick up a book and read it for a minimum amount of time.

Thus, a bookmark with timer and alarm to promote reading addressing the aforementioned problems is desired.

SUMMARY OF THE INVENTION

Embodiments of a bookmark with timer and alarm to promote reading include an electronic circuit including a controller, a light sensor to detect light, a light source to emit light and a sound source to emit sound, to alert a user or a reader to continue reading a certain book, magazine, etc. after a specific time. When the light sensor senses a minimum threshold amount of light, a first timer resets to an initial time and when the light sensor is not exposed to the minimum threshold amount of light, the first timer counts from the initial time a first time period and, if the minimum threshold amount of light is detected during the count of the first time period, the controller starts a second timer to count a second time period, and if the light sensor is not exposed to the minimum threshold amount of light during the count of the second time period, the controller activates an alarm, the alarm including at least one of activating the light source to emit light or activating the sound source to emit sound, such as according to user specified settings.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

Figure 1:
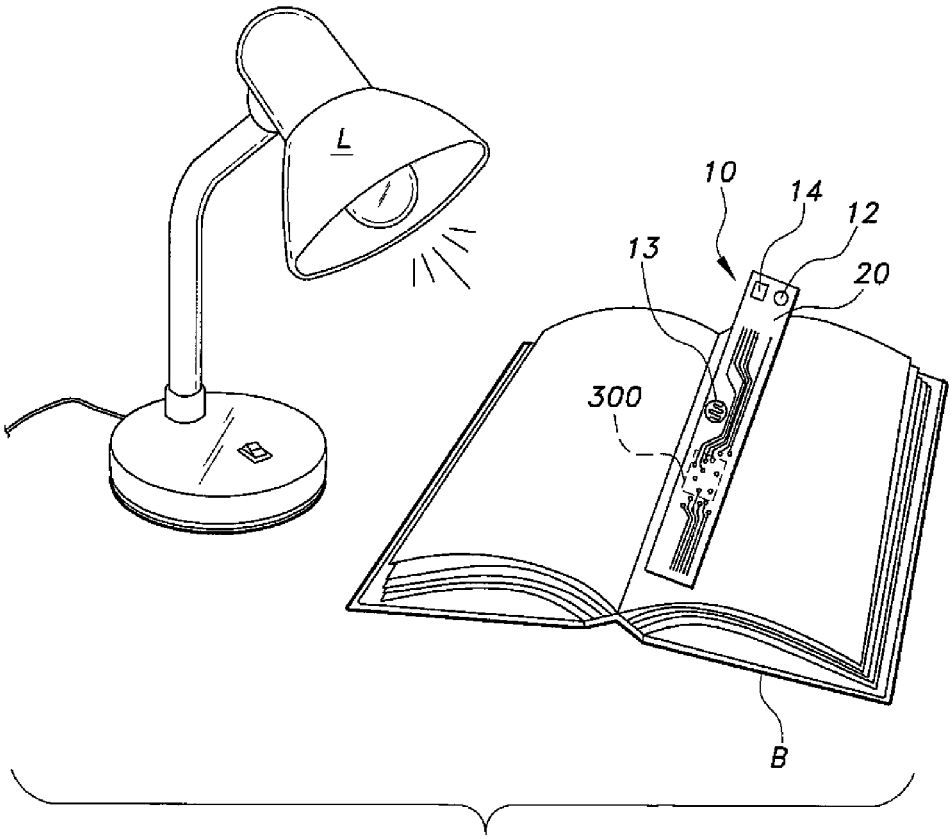
FIG. 1 is an environmental, perspective view of a bookmark with timer and alarm to promote reading according to the present invention.
Figure 2:
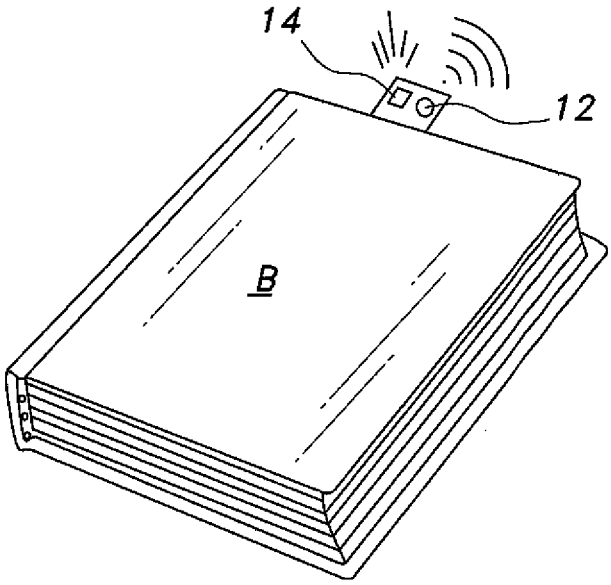
FIG. 2 is an environmental perspective view of the bookmark with timer and alarm to promote reading, showing activation of the bookmark alarms according to the present invention.

At the outset, it should be understood by one of ordinary skill in the art that embodiments of a bookmark with timer and alarm can include software or firmware code executing on a computer, a microcontroller, a microprocessor, or a digital signal processor (DSP) processor; state machines implemented in application specific or programmable logic; or numerous other forms, for example. Also, embodiments of a bookmark with timer and alarm can include, be implemented by or be provided with a computer program, which includes a non-transitory machine-readable medium having stored thereon instructions that can be used to program a computer (or other electronic devices) to perform a process implementing embodiments of a bookmark with timer and alarm to promote reading. The machine-readable medium can include, but is not limited to, floppy diskettes, optical disks, CD-ROMs, and magneto-optical disks, ROMs, RAMs, EPROMs, EEPROMs, magnetic or optical cards, flash memory, or other type of media or machine-readable medium suitable for storing electronic instructions, for example, and should not be construed in a limiting sense.

As shown in FIGS. 1 through 3B, embodiments of a bookmark with timer and alarm to promote reading, such as a bookmark with timer and alarm 10, are illustrated. The bookmark with timer and alarm 10 includes an electronic circuit to alert a user of the bookmark, such as a reader of a book, to continue reading a certain book, magazine, etc. after a specific time has elapsed. The bookmark with timer and alarm 10 is of a suitable physical dimension to form a bookmark and includes a substrate 20 including a circuit board 25. The substrate 20 can be a thin, elongate substrate of physical dimension that provides functionality as a bookmark, for example.

A controller 300 is disposed on the circuit board 25. A plurality of input/output (I/O) lines, such as I/O lines 21, 22 and 23, are in communicating relation with the controller 300, as can be communicatively connected to the controller 300, and are disposed on and extending from the circuit board 25. An example of a controller 300, is a microcontroller unit (MCU), such as a LilyPad Arduino SimpleSnap MCU, but can include any of various suitable controllers and processors, as can depend on the use or application, and should not be construed in a limiting sense.

The LilyPad Arduino SimpleSnap MCU, as an example of an MCU 300, includes a plurality of input/output (I/O) lines or pins including analog, digital and pulse-width modulation (PWM) pins or lines, and a pair of lines or pins connectable to a direct current (DC) power source such as, for example, a 3.7 volt (V) lithium power (LiPo) battery. Also, the LilyPad Arduino SimpleSnap MCU is based on and typically can include an Atmel® ATmega328 microcontroller as a MCU, for example. The Atmel® ATmega328 microcontroller is a RISC-based microcontroller that combines 32 kilobyte (KB) in-system programming (ISP) flash memory with read-while-write capabilities, 1 KB EEPROM, 2 KB SRAM, various general purpose I/O lines, 32 general purpose working registers, three flexible timer/counters with compare modes, internal and external interrupts, a serial programmable a universal synchronous/asynchronous receiver/transmitter (QSART), a byte-oriented 2-wire serial interface, a serial peripheral interface (SPI) serial port, a 6-channel 10-bit analog/digital (A/D) converter, and a programmable watchdog timer with internal oscillator, for example.

Thus, the controller 300, as can be based on, include or be similar to the LilyPad Arduino SimpleSnap MCU, for example, can be programmed to implement instructions, such as can be stored in a memory 304 associated with the controller 300. Such programming or instructions can, for example, implement selectively setting or programming one or more timers, such as a timer first 306 and a second timer 307 associated with, or can be integrally within, the controller 300, and implementing counts of the set times in determining whether to activate an alarm or alarms to alert a user of the bookmark with timer and alarm 10. Also, an I/O line associated with the controller 300 can be pulse width modulated, as can be determined by programming in the controller 300, such as can provide a pulse-width modulation (PWM) signal, for example.

Figure 3A:
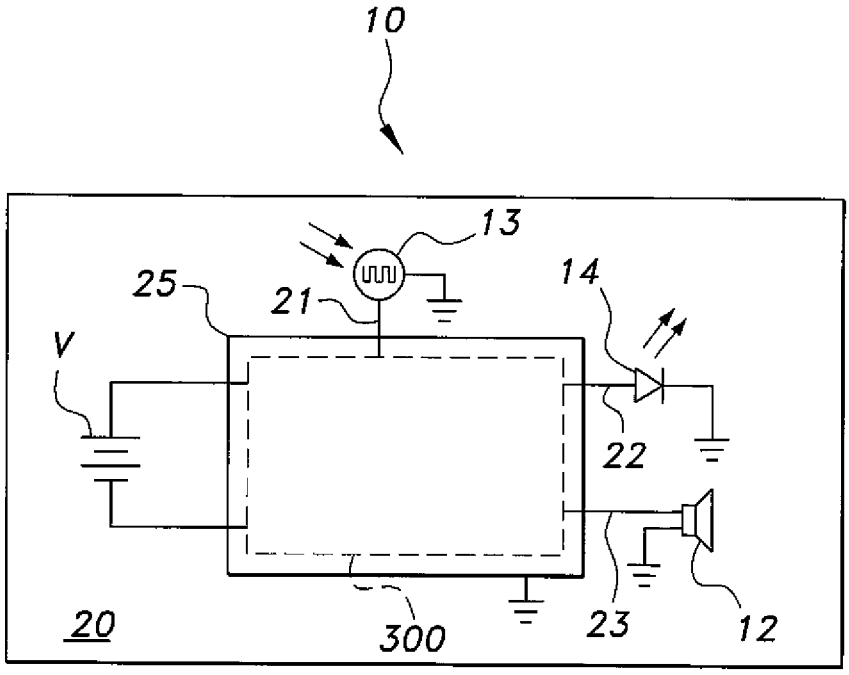
FIG. 3A is a schematic diagram of a bookmark with timer and alarm including a controller and associated light sensor, light source and sound source according to the present invention.

A light sensor 13, such a cadmium sulfide (CdS) light sensor, for example, is disposed on the substrate 20 in communication with the controller 300, such as through the I/O line 21, the light sensor 13 adapted to sense light. Various types of suitable light sensors can be used, such as a LilyPad Light Sensor, as can depend on the use or application, and should not be construed in a limiting sense. Also, a sound source 12, such as the diagrammatically illustrated buzzer or speaker in FIG. 3A, is disposed on the substrate 20 in communication with the controller 300, such as through the I/O line 23, the sound source 12 being adapted to emit sound. Various types of suitable sound sources can be used, such as various suitable buzzers or speakers, as can depend on the use or application, and should not be construed in a limiting sense.

A light source 14, such as the illustrated at least one light emitting diode (LED), is disposed on the substrate 20 in communication with the controller 300, such as through the I/O line 22, the light source 14 being adapted to emit light. Various types of suitable light sources can be used, such as various types or arrangements of LED diodes, as can depend on the use or application, and should not be construed in a limiting sense.

Further, one or more timers, such as the first timer 306 and the second timer 307, as can be combined into a single integral timer, are associated with the controller 300 to set an initial time and a first time period and to count from an initial time the first time period when the light sensor 13 is not exposed to a minimum threshold amount of light and to set and count a second time period. The minimum threshold amount of light can be a predetermined amount of light, such as a predetermined level of light, as can be determined based on a use, an application or an environment of the bookmark with timer and alarm 10, for example. The first timer 306 can set the initial time and the first time period and can count the first time period and the second timer 307 can set the second time period and can count the second time period, for example. The first time period and the second time period can be selectively set and can be selectively programmable, such as by a user of the bookmark, for example. Also, the selectively set or selectively programmable first time period and second time period, as well as the initial time, as can also be selectively set or programmable, can be stored in the memory 304, such as can be associated with the controller 300.

Figure 3B:
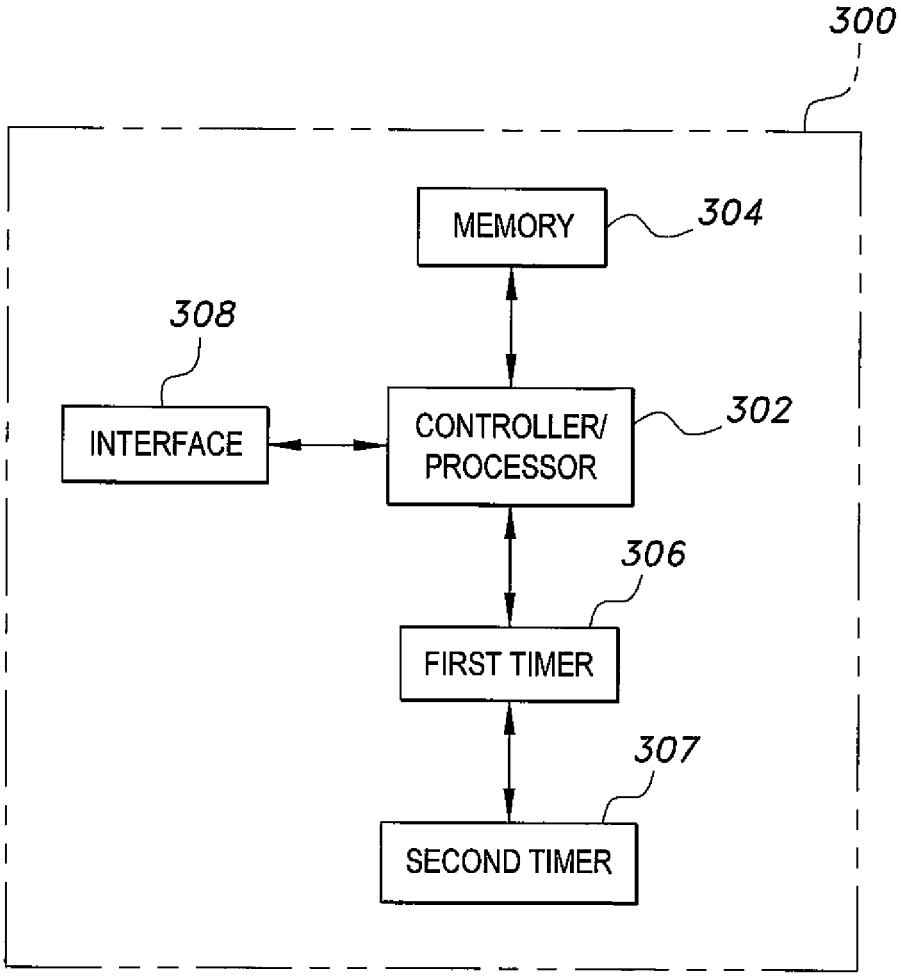
FIG. 3B is a schematic block circuit diagram of the controller of FIG. 3A of the bookmark with timer and alarm to promote reading according to the present invention.

As illustrated in FIG. 3B, a schematic diagram of the controller 300 is illustrated for implementing instructions and processes in determining whether to activate an alarm to alert a user of the bookmark with timer and alarm 10. Data, such as the initial time, the first time period and the second time period, as well as programming and instructions, can be entered into the controller 300, such as by a user via any suitable type of user interface 308, as can include one or more of a plurality of I/O lines or pins, and can be stored in computer readable memory, such as memory 304, which can be any suitable type of computer readable and programmable memory. Determination and calculations are performed by a controller/processor 302, which can be any suitable type of computer processor as can be associated with, or incorporated into, any suitable type of computing device, for example, a programmable logic controller (PLC) or an application specific integrated circuit (ASIC).

The controller/processor 302, the memory 304, the first timer 306, the second timer 307 and the interface 308, and any associated computer readable media, can be in communication with one another by any suitable type of data bus, as is well known in the art. Examples of computer readable media can include non-transitory computer readable storage memory and/or a semiconductor memory (for example, RAM, ROM, etc.).

In the book mark with timer and alarm 10, when the light sensor 13 is not exposed to the minimum threshold amount of light, the controller 300 starts a corresponding timer of the one or more timers, such as the first timer 306, to count from the initial time the first time period and, if the minimum threshold amount of light is detected during the count of the first time period, the controller 300 starts a corresponding timer of the one or more timers, such as the second timer 307, to count the second time period.

If the controller 300 determines that the light sensor 13 is not exposed to the minimum threshold amount of light during the count of the second time period, the controller 300 activates an alarm or alarms to alert a user of the bookmark with timer and alarm 10, the alarm or alarms including at least one of activating the light source 14 to emit light or activating the sound source 12 to emit sound. The controller 300 can activate the alarm or alarms in a pulsating manner, such as to control the light source 14 to emit light in a blinking type pattern or control the sound source 12 to emit distinct sound bursts, such as from a speaker or buzzer, for example. Also, the controller 300 can activate the alarm in a steady state manner, such as to control the light source 14 to emit light in a continuous type light pattern, such as from a LED, or control the sound source 12 to emit a continuous type sound pattern, such as from a speaker or buzzer, for example. Also, the controller 300 can control activating the alarm or alarms in a combination of a pulsating manner and a steady state manner, for example, and should not be construed in a limiting sense.

In this regard, for example, when the light sensor 13 senses light, such as can be a minimum threshold amount of light, an interior timer, such as the first timer 306, as can be determined by software in the controller 300, resets to an initial time, such as 00:00. When sufficient light, such as the minimum threshold amount of light, no longer impinges upon the light sensor 13, the timer, such as the first timer 306 associated with the controller 300, as can be a timer in a LilyPad Arduino SimpleSnap MCU, for example, starts counting from the initial time the first time period, for a user specified waiting time, e.g. approximately 72 hours.

If during the count of the first time period, such as a user specified waiting time, the minimum threshold amount of light is detected, the controller 300 starts a corresponding timer of the one or more timers, such as the second timer 307, to count the second time period. If the controller 300 determines that the light sensor 13 is not exposed to the minimum threshold amount of light during the count of the second time period, e.g. the user does not begin reading the book, magazine, etc. in a lit environment for a minimum reading time, e.g., approximately of 5 minutes, the controller 300 activates an alarm or alarms to alert a user of the bookmark with timer and alarm 10, the alarm including at least one of activating the light source 14 to emit light, such as a flashing light, or activating the sound source 12 to emit sound, such as a buzzing type sound, according to user specified settings, for example.

As shown in FIG. 1, initially, when a book B is open with the lamp L or other light source, such as natural light, daylight, sunlight or a room light, shining light thereon with the bookmark with timer and alarm 10 exposed to light from the lamp L or other light source, the light sensor 13, such as a Cadmium Sulfide (CdS) light sensor, of the bookmark with timer and alarm 10 is exposed to the light from the lamp L or other light source and, based on the received light by the light sensor 13, the controller 300 sets the primary timer count to the initial time, such as to 00:00, as can be programmed in the memory 304 associated with the controller 300.

When the book B is closed, and the bookmark with timer and alarm 10 is not exposed to a minimum threshold amount of light, the primary timer count begins to count the first time period, and the duration of the first time period can be determined by a user programmable parameter, for example. As mentioned, the bookmark with timer and alarm 10 includes a sound source 12, such as an audible buzzer alarm and a light source 14, such as a flashing light alarm, for example. At least one alarm is triggered by the controller 300 causing the light source 14 alarm to flash and/or the sound source 12 alarm to generate a sound, such as an audible buzzer sound, so as to deliver a visual alert and/or audible alert if during the primary count duration of the first time period, such as for approximately 72 hours, the user has not opened the book for a secondary count duration of the second time period, e.g., at least approximately 5 minutes. Also, the light source 14 and/or sound source 12 can be programmed to turn on in a steady state manner or a pulsing manner, or a combination thereof. The generated alarm(s) alert the user of the bookmark with timer and alarm 10 that it is time to resume reading the book, for example.

During the secondary count of the second time period, e.g. the aforementioned approximately 5 minute time period, the user must keep the light sensor 13 of the bookmark with timer and alarm 10 exposed to a minimum threshold amount of light, such as by keeping the book, magazine, etc. open. If the light sensor 13 of the bookmark with timer and alarm 10 is not exposed to a minimum threshold amount of light for the duration of the second time period, the controller 300 will command one or more alarms to activate, such as the sound source 12 and/or the light source 14 to activate. Also, the alarm(s) can be silenced, for example, by exposing the light sensor 13 of the bookmark with timer and alarm 10 to light in a well-lit environment, such as being exposed to the minimum threshold amount of light by opening the book having the bookmark with timer and alarm 10 therein, for example. Exemplary program instructions or operations implemented by the controller 300, such as can be stored in the memory 304 and implemented by the controller/processor 302, to determine activation of the alarm(s) are shown in Table 1.

TABLE 1

| Controller Process | |
|---|---|
| Step | Process |
| 1 | set a primary timer duration time of a first time period for a primary timer; |
| 2 | set a secondary timer duration time of a second time period for a secondary timer; |
| 3 | if a light sensor is exposed to a minimum threshold amount of light, set/reset the primary timer to an initial time; |
| 4 | when the light sensor is not exposed to the minimum threshold amount of light, start the primary timer to count up from the initial time to the set primary timer duration time of the first time period; |
| 4 | if the minimum threshold amount of light is detected during the primary timer count of the primary timer duration time of the first time period, start the secondary timer to count the secondary timer duration time of the second time period; |
| 5 | activating an alarm if during the primary timer count the light sensor is not exposed to the minimum threshold amount of light for the set secondary timer duration of time of the second time period. |

In the exemplary configuration of FIG. 3A, the light sensor 13 is a peripheral to the controller 300 that is connected to the I/O line 21, the sound source 12 is a peripheral to the controller 300 that is connected to I/O line 23, and the light source 14 is a peripheral to the controller 300 that is connected to the I/O line 22. An initialization code can be used to initialize I/O line 21 to be an input, and the I/O lines 22 and 23 to be outputs, for example.

Accordingly, as programmed by the user, as described, at the appropriate times an output can be provided over the I/O line 23 to activate an audible alarm generated by the sound source 12 or an output can be provided over the I/O line 22 to activate a visible alarm generated by the light source 14, or outputs can be provided over both lines 22 and 23 to activate both an audible alarm generated by the sound source 12 and a visible alarm generated by the light source 14, such as to provide a multisensory alarm effect, for example. As described, a user of the bookmark with timer and alarm 10 can prevent an alarm activation by exposing the light sensor 13 to a minimum threshold amount of light, such as by reading the book for at least approximately 5 minutes, for example, or for any other user/factory programmed predetermined minimum reading time, as the second time period, during the specified waiting time of the first time period, such as approximately 72 hours, or for any other user/factory pre-programmed predetermined time for the first time period, and should not be construed in a limiting sense.

It is to be understood that the present invention is not limited to the embodiments described above, but encompasses any and all embodiments within the scope of the following claims.

I claim:

1. A bookmark with timer and alarm, comprising:

a substrate of physical dimension to form a bookmark including a circuit board;

a controller disposed on the circuit board;

a light sensor disposed on the substrate in communication with the controller, said light sensor adapted to sense light;

at least one of a sound source or a light source disposed on the substrate in communication with the controller, said sound source being adapted to emit sound and said light source being adapted to emit light; and one or more timers associated with the controller to set an initial time and a first time period and to count from an initial time the first time period when the light sensor is not exposed to a minimum threshold amount of light and to set and count a second time period, wherein, when the light sensor is not exposed to the minimum threshold amount of light, the controller starts a corresponding timer of the one or more timers to count from the initial time the first time period and, if the minimum threshold amount of light is detected during the count of the first time period, the controller starts a corresponding timer of the one or more timers to count the second time period, and if the light sensor is not exposed to the minimum threshold amount of light during the count of the second time period, the controller activates at least one alarm, the at least one alarm including at least one of activating the light source to emit light or activating the sound source to emit sound.

2. The bookmark with timer and alarm according to claim 1, wherein said sound source comprises at least one of a speaker or a buzzer.

3. The bookmark with timer and alarm according to claim 1, wherein said light source comprises a light emitting diode (LED).

4. The bookmark with timer and alarm according to claim 1, wherein said light sensor comprises a cadmium sulfide (CdS) light sensor.

5. The bookmark with timer and alarm according to claim 1, wherein said sound source comprises at least one of a speaker or a buzzer, said light source comprises a light emitting diode (LED), and said light sensor comprises a cadmium sulfide (CdS) light sensor.

6. The bookmark with timer and alarm according to claim 5, wherein said controller activates the at least one alarm in at least one of a pulsing manner or a steady state manner, or a combination thereof.

7. The bookmark with timer and alarm according to claim 1, wherein said second time period is approximately five minutes.

8. The bookmark with timer and alarm according to claim 1, wherein said first time period is approximately seventy two hours.

9. The bookmark with timer and alarm according to claim 8, wherein said second time period is approximately five minutes.

10. The bookmark with timer and alarm according to claim 1, wherein said first time period and said second time period are selectively set.

11. The bookmark with timer and alarm according to claim 10, wherein said selectively set first time period and said selectively set second time period are stored in a memory associated with the controller.

12. The bookmark with timer and alarm according to claim 1, wherein said first time period and said second time period are selectively programmable by a user of the bookmark.

13. The bookmark with timer and alarm according to claim 12, wherein said selectively programmable first time period and said selectively programmable second time period are stored in a memory associated with the controller.

14. The bookmark with timer and alarm according to claim 1, further comprising:

a memory associated with the controller, wherein said first time period and said second time period are stored in the memory associated with the controller.

15. The bookmark with timer and alarm according to claim 14, wherein said controller activates the at least one alarm in at least one of a pulsing manner or a steady state manner, or a combination thereof.

16. The bookmark with timer and alarm according to claim 1, wherein said controller activates the at least one alarm in at least one of a pulsing manner or a steady state manner, or a combination thereof.

17. The bookmark with timer and alarm according to claim 1, wherein said controller comprises a microcontroller unit (MCU).

18. The bookmark with timer and alarm according to claim 17, wherein said sound source comprises at least one of a speaker or a buzzer, said light source comprises a light emitting diode (LED), and said light sensor comprises a cadmium sulfide (CdS) light sensor.

19. The bookmark with timer and alarm according to claim 1, further comprising:

a plurality of input/output (I/O) lines in communicating relation with said controller, said plurality of I/O lines extending from the circuit board, wherein said plurality of I/O lines are in respective communicating relation with said light sensor, said light source and said sound source.

20. A bookmark with timer and alarm to promote reading, comprising:

a thin, elongate substrate of physical dimension that provides functionality as a bookmark including a circuit board;

a microcontroller unit (MCU) disposed on the circuit board;

first, second, and third input/output (I/O) lines extending from the circuit board, said first, second, and third I/O lines being communicatively connected to said MCU;

a light sensor adapted to sense light connected to said first I/O line in communicating relation to said MCU;

a sound source adapted to emit sound being connected to said second I/O line in communicating relation to said MCU;

a light source adapted to emit light connected to said third I/O line in communicating relation with said MCU;

means for setting an alarm associated with said MCU based on a first time period and a second time period; and means for activating said alarm associated with said MCU when, within said first time period, said light sensor detects a minimum threshold amount of light and fails to detect the minimum threshold amount of light for the second time period, wherein said alarm includes at least one of activating the light source to emit light or activating the sound source to emit sound.

* * * * *